US005772054A

United States Patent [19]

Potter

[11] Patent Number: 5,772,054

[45] Date of Patent: Jun. 30, 1998

[54] DISPLAY RACK

[76] Inventor: Eugene Potter, 3919 Avenue P, Brooklyn, N.Y. 11234

[21] Appl. No.: 699,418

[22] Filed: Aug. 19, 1996

[51] Int. Cl.[6] ..... A47F 5/00

[52] U.S. Cl. ..... 211/87.01; 211/133.3

[58] Field of Search ..... 211/103, 87.01, 211/88, 189, 40, 41, 208, 94.01, 133.1, 133.3, 126, 182

[56] References Cited

U.S. PATENT DOCUMENTS

| | | | |
|---|---|---|---|
| 4,508,231 | 4/1985 | Honickman | 211/87 |
| 4,548,327 | 10/1985 | Kilkelly | 211/208 |
| 4,632,260 | 12/1986 | Hart et al. | 211/87.01 |
| 4,949,849 | 8/1990 | Hardy . | |
| 5,333,745 | 8/1994 | Lehmann . | |
| 5,472,100 | 12/1995 | Garrison et al. . | |

*Primary Examiner*—Peter M. Cuomo
*Assistant Examiner*—Gerald A. Anderson
*Attorney, Agent, or Firm*—Michael I. Kroll

[57] ABSTRACT

A display rack (10) comprising a support structure (12). A facility (14) is for mounting the support structure (12) to a flat vertical wall (16). A plurality of elongated J-channels (18) are provided. A plurality of fasteners (20) are for affixing the J-channels (18) to the support structure (12) in spaced apart parallel horizontal positions, so that a plurality of blister packages (22) with toy cars (24) therein or other small articles can be held in the J-channels (18) and be displayed therefrom.

13 Claims, 3 Drawing Sheets

10
12
20
26
62
18
40
42
10
12
28
26
44
38
48
36
22
18
22
40
20
24

DISPLAY RACK

BACKGROUND OF THE INVENTION

1. Field of the Invention

The instant invention relates generally to merchandising display units and more specifically it relates to a display rack for toy cars or other small articles.

2. Description of the Prior Art

Numerous merchandising display units have been provided in prior art. For example, U.S. Pat. Nos. 4,949,849 to Hardy, 5,333,745 to Lehmann and 5,472,100 to Garrison et al. all are illustrative of such prior art. While these units may be suitable for the particular purpose to which they address, they would not be as suitable for the purposes of the present invention as heretofore described.

HARDY, STEPHEN

ADJUSTABLE GREETING CARD DISPLAY ASSEMBLY

U.S. Pat. No. 4,949,849

Adjustable greeting card display assembly. This assembly has a supporting structure and a display panel formed by a plurality of pocket forming central dividers and a pair of pocket forming end dividers. Each central divider includes a plurality of half pockets in step relationship, formed by a vertical sheet which forms a common side wall for the half pockets, and sheets extending laterally in both directions from the vertical sheet to form the fronts, backs and bottoms of the half pockets. The end dividers are like the central divider except that the sheets forming the fronts, backs and bottoms of the half pockets extend in only one direction from the vertical sheet. The supporting structure includes at least one transversely extending slotted support rail. Each of the dividers includes a transverse socket for the support rail, and a vertical web which engages a selected slot in the support rail. Each pair of adjacent dividers together form a series of whole pockets for cards. The dividers can be moved closer together or farther apart as desired, depending on the width of the cards to be displayed.

LEHMANN, PAUL F.

MERCHANDISING DISPLAY UNIT

U.S. Pat. No. 5,333,745

A merchandising display unit particularly suited for storing and displaying groups of small items of variable sizes. The basic unit includes an elongated horizontal channel having an arcuate wall cross-section extending substantially 180 degrees around the horizontal axis, a front and real longitudinal edge and a supporting member receivable in an aperture formed within the channel. The front longitudinal edge terminates in a forward surface, having a longitudinal guide track for slideably receiving and holding a label receptacle. The supporting member includes an elongated projection mating with an aperture of the channel to support the channel in a substantially horizontal position. Each end of the channel has a removable planar transverse end barrier. Each end barrier has a generally linear upper surface, and a generally arcuate lower periphery that is coextensive with the arcuate wall cross-section of the channel and has a projection extending normal to the planar wall with a diameter slightly larger than that of the channel. One or more dividers are transversely positioned between the end barriers, to provide separate item compartments of desirable length.

GARRISON, DONALD W. KEIGHLEY, WILLIAM S. PaVONE, JERRY D. SHATZER, KEVIN P.

GREETING CARD DISPLAY RACK

U.S. Pat. No. 5,472,100

A greeting card display device comprising a base and a pair of display modules stacked one atop another and mounted on the base. Each module comprises four upright support panels secured together at adjacent vertical edges, and a plurality of card-supporting tiers secured to the upright support panels. Each of the support panels is in the form of a U-shaped channel section having a pair of side walls and a web wall connected between the side walls. Adjacent vertical edges of the support panels are secured together by securing the side wall of one of the adjacent panels to the web wall of the other adjacent panel. The panels include a plurality of slots which accept tabs on the tiers. Each tier comprises a back, bottom and a front wall connected at adjacent horizontal edges, a pair of securement tabs connected at the upper free edge of the back wall and projecting upwardly and rearwardly, and a pair of securement tabs connected to the lower edge of the back wall and projecting downwardly and rearwardly.

SUMMARY OF THE INVENTION

A primary object of the present invention is to provide a display rack that will overcome the shortcomings of the prior art devices.

Another object is to provide a display rack that is mounted to a wall, which will display blister packages that houses die cast cars, such as Hot Wheels, Matchbox, etc. and other small articles.

An additional object is to provide a display rack that will allow for easy movement of the individual blister packages or other small articles to different locations on the display rack, without having to remove the display rack from the wall.

A further object is to provide a display rack that is simple and easy to use.

A still further object is to provide a display rack that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
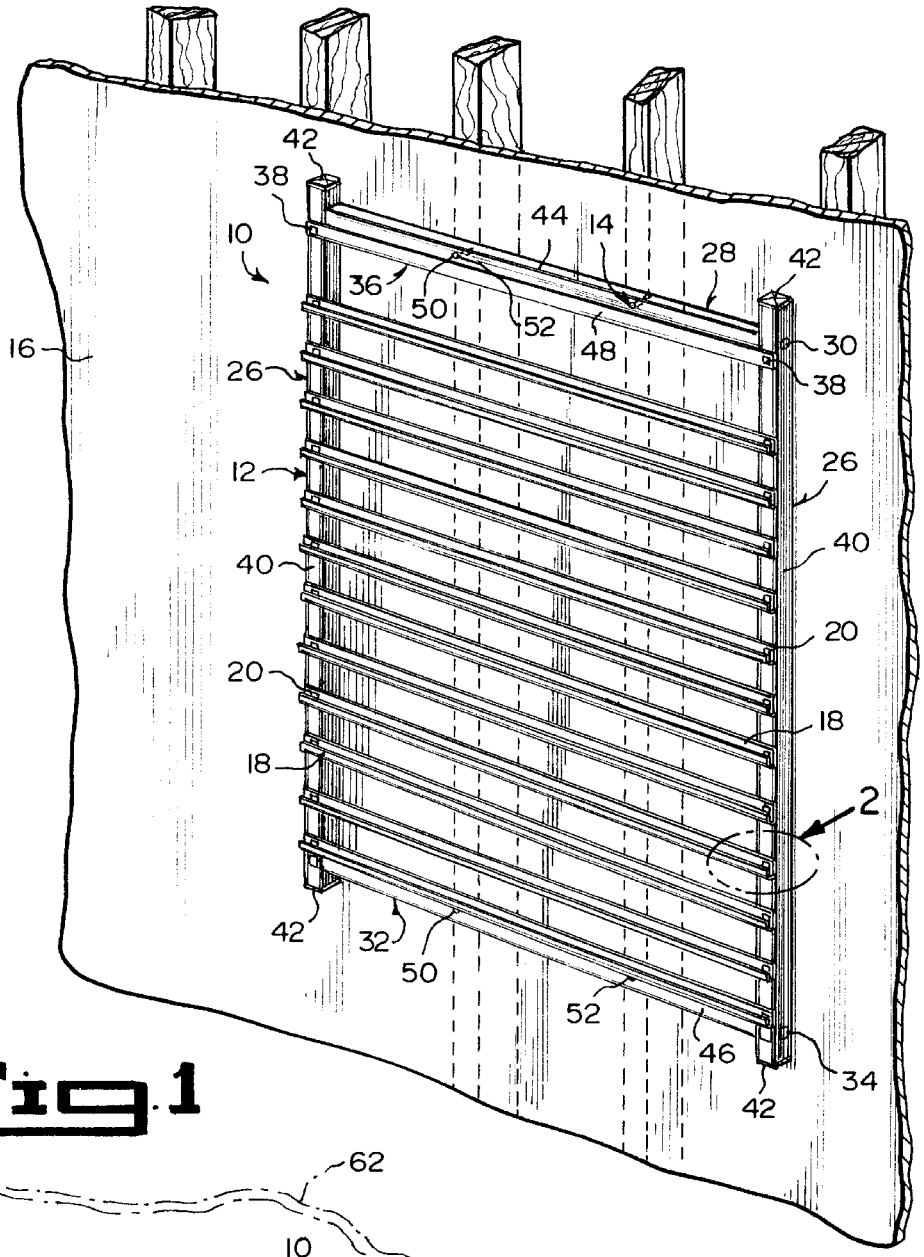
FIG. 1 is a perspective view of a first embodiment of the instant invention mounted to a wall.

Turning now descriptively to the drawings, in which similar reference characters denote similar elements throughout the several views, FIGS. 1 through 6 illustrate a display rack 10 comprising a support structure 12. A facility 14 is for mounting the support structure 12 to a flat vertical wall 16. A plurality of elongated J-channels 18 are provided. A plurality of fasteners 20 are for affixing the J-channels 18 to the support structure 12 in spaced apart parallel horizontal positions, so that a plurality of blister packages 22 with toy cars 24 therein or other small articles can be held in the J-channels 18 and be displayed therefrom. The other small articles can be toys, dolls, cards, pictures and similar items.

The support structure 12 includes a pair of side posts 26. A top rail 28 is provided. Two fasteners 30 are for securing opposite ends of the top rail 28 near to top ends of the side posts 26. The top rail 28 extends horizontally between the side posts 26 which are positioned vertically. A bottom rail 32 is also provided. Two fasteners 34 are for securing opposite ends of the bottom rail 32 near to bottom ends of the side posts 26. The bottom rail 32 also extends horizontally between the side posts 26.

The support structure 12 further contains a stabilizer bar 36. Two fasteners 38 are for attaching opposite ends of the stabilizer bar 36 to the side posts 26 adjacent to the top rail 28, so as to increase the stability of the support structure 12. Each side post 26 is a hollow tube 40 that is square shaped in cross section. Each side post 26 includes two snap on end caps 42.

The top rail 28 is a hollow tube 44 that is square shaped in cross section. The bottom rail 32 is a hollow tube 46 that is square shaped in cross section. The stabilizer bar 36 is a flat elongate rectangular member 48.

The mounting facility 14 consists of the top rail 28 and the bottom rail 32 each having a plurality of mounting holes 50 therethrough. A plurality of mounting screws 52 are provided. Each mounting screw 52 can extend through one mounting hole 50 and into the flat vertical wall 16.

Figure 5:
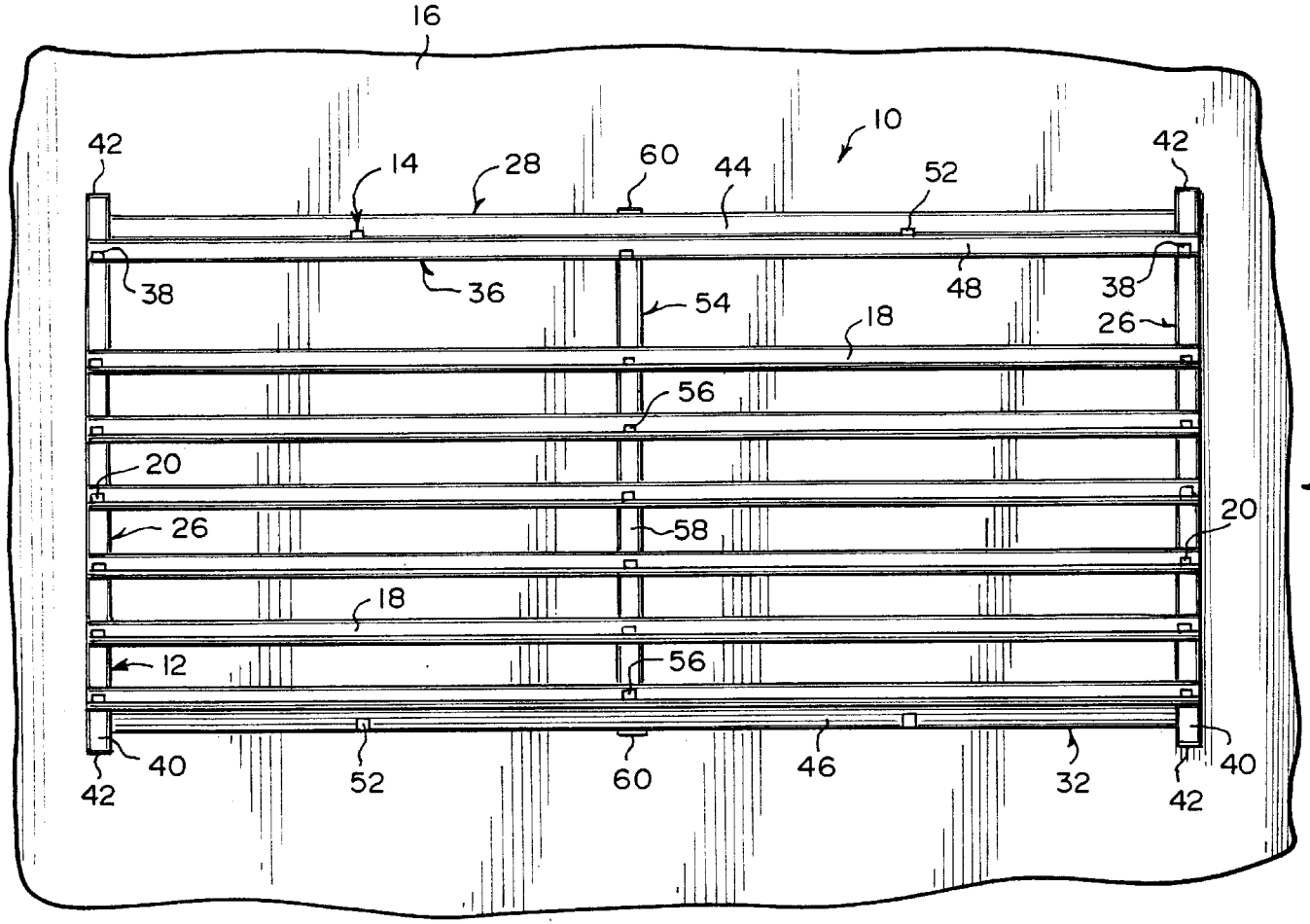
FIG. 5 is a front view of a second embodiment of the instant invention mounted to a wall.

As best seen in FIG. 5, the support structure 12 further contains a center post 54. A plurality of fasteners 56 are for securing the center post 54 in a vertical position between the side posts 26. The center post 54 is a hollow tube 58 that is square shaped in cross section. The center post 54 includes two snap on end caps 60.

Figure 2:
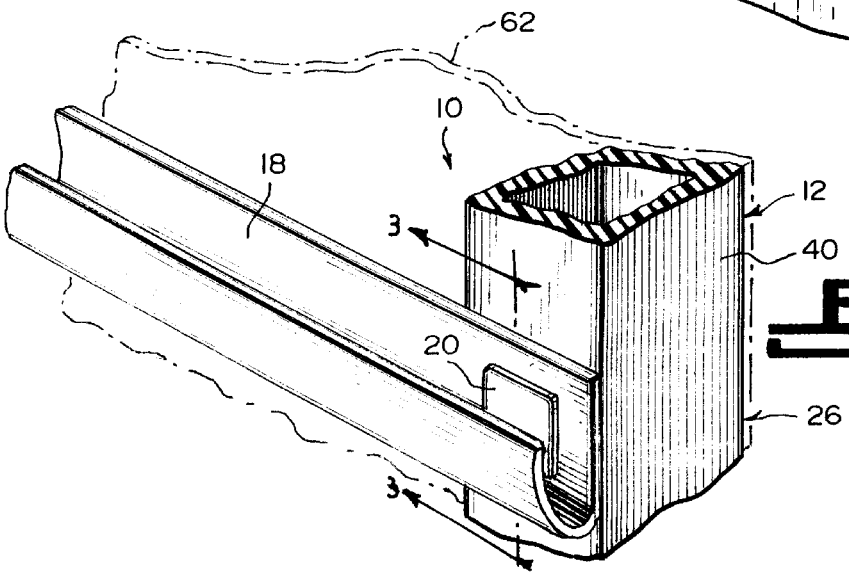
FIG. 2 is an enlarged perspective view of a portion of the first embodiment as indicated by arrow 2 in FIG. 1.
Figures 3, 4:
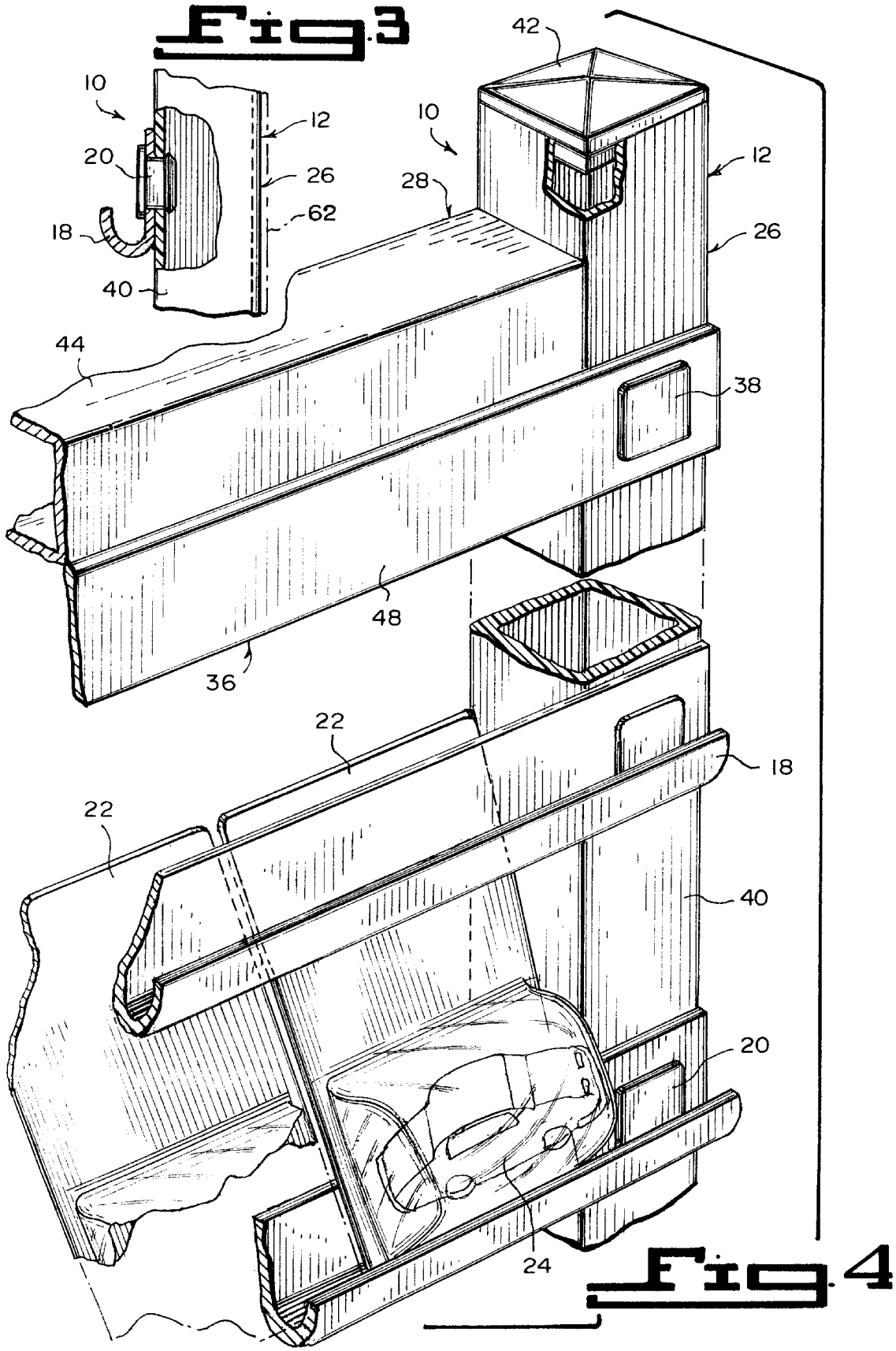
FIG. 3 is a partial cross sectional view taken along line 3—3 in FIG. 2.
FIG. 4 is an enlarged perspective view of portions of the first embodiment, showing two blister packages being displayed therefrom.
Figure 6:
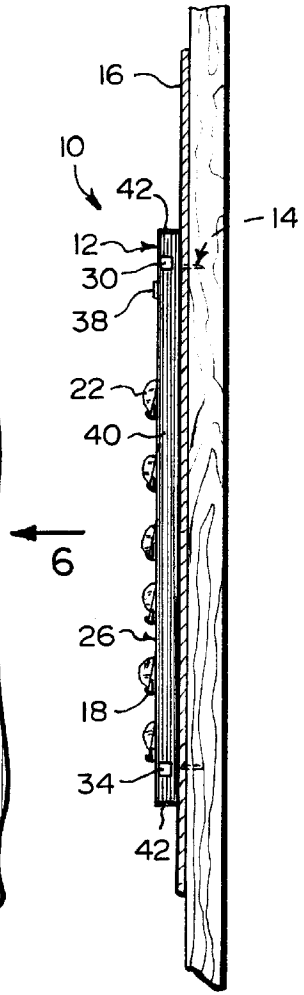
FIG. 6 is a side view taken in the direction of arrow 6 in FIG. 5, with blister packages being displayed therefrom.

The display rack 10 can include a back wall 62, as shown in phantom in FIGS. 2 and 3. The back wall 62 is affixed to and extends between the side posts 26, so as to make the display rack 10 portable.

OPERATION OF THE INVENTION

To use the display rack 10, the following steps should be taken:

1. Attach the top rail 28 with the two fasteners 30 to the side posts 26.
2. Attach the bottom rail 32 with the two fasteners 34 to the side posts 26.
3. Secure the stabilizer bar 36 with the two fasteners 38 to the side posts 26 adjacent the top rail 28.
4. Affix all of the J-channels 18 to the side posts 26 with the fasteners 20.
5. Mount the support structure 12 to the flat vertical wall 16 by the mounting screws 52 extending through the mounting holes 50 in the top rail 28 and the bottom rail 32 and into the flat vertical wall 16.
6. Place the blister packages 22 with the toy cars 24 or other small articles into the J-channels 18, so that the blister packages 22 or other small articles will tilt back against the flat vertical wall 16 and be displayed therefrom.

LIST OF REFERENCE NUMBERS

10 display rack
12 support structure of 10
14 mounting facility of 10 for 12
16 flat vertical wall
18 elongated J-channel of 10
20 fastener for 18 of 10
22 blister package
24 toy car in 22
26 side post of 12
28 top rail of 12
30 fastener for 28 of 12
32 bottom rail of 12
34 fastener for 32 of 12
36 stabilizer bar of 12
38 fastener for 36 of 12
40 hollow tube for 26
42 snap on end cap of 26
44 hollow tube for 28
46 hollow tube for 32
48 flat elongate rectangular member for 36
50 mounting hole in 28 and 32
52 mounting screw of 14
54 center post of 12
56 fastener for 54 of 12
58 hollow tube for 56
60 snap on end cap of 54
62 back wall of 10

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A display rack comprising:

a) a support structure including:

i) a pair of side posts;

ii) a top rail;

iii) two fasteners for securing opposite ends of said top rail near to top ends of said side posts, so that said top rail extends horizontally between said side posts which are positioned vertically;

iv) a bottom rail; and v) two fasteners for securing opposite ends of said bottom rail near to bottom ends of said side posts, so that said bottom rail extends horizontally between said side posts;

b) means for mounting said support structure to a flat vertical wall;

c) a plurality of elongated J-channels;

d) a plurality of fasteners for affixing said J-channels to said support structure in spaced apart parallel horizontal positions, so that a plurality of blister packages with toy cars therein and other small articles can be held in said J-channels and be displayed therefrom; and e) a back wall affixed to and extending between said side posts, so as to make said display rack portable.

2. A display rack as recited in claim 1, wherein said support structure further includes:

a) a stabilizer bar; and b) two fasteners for attaching opposite ends of said stabilizer bar to said side posts adjacent to said top rail, so as to increase the stability of said support structure.

3. A display rack as recited in claim 2, wherein said stabilizer bar is a flat elongate rectangular member.

4. A display rack as recited in claim 1, wherein each said side post is a hollow tube that is square shaped in cross section.

5. A display rack as recited in claim 4, wherein each said side post includes two snap on end caps.

6. A display rack recited in claim 4, wherein each said side post includes two snap on end caps.

7. A display rack as recited in claim 6, wherein said top rail is a hollow tube that is square shaped in cross section.

8. A display rack as recited in claim 7, wherein said bottom rail is a hollow tube that is square shaped in cross section.

9. A display rack as recited in claim 8, wherein said stabilizer bar is a flat elongate rectangular member.

10. A display rack as recited in claim 8, wherein said mounting means includes:

a) said top rail and said bottom rail each having a plurality of mounting holes therethrough; and b) a plurality of mounting screws, whereby each said mounting screw can extend through one mounting hole and into the flat vertical wall.

11. A display rack as recited in claim 1, wherein said top rail is a hollow tube that is square shaped in cross section.

12. A display rack as recited in claim 1, wherein said bottom rail is a hollow tube that is square shaped in cross section.

13. A display rack as recited in claim 1, wherein said mounting means includes:

a) said top rail and said bottom rail each having a plurality of mounting holes therethrough; and b) a plurality of mounting screws, whereby each said mounting screw can extend through one mounting hole and into the flat vertical wall.

* * * * *